US008007225B2

(12) United States Patent
Ko

(10) Patent No.: US 8,007,225 B2
(45) Date of Patent: Aug. 30, 2011

(54) CROSS FLOW FAN

(76) Inventor: Chen-Hui Ko, Taoyuan Hsien (TW)

( * ) Notice: Subject to any disclaimer, the term of this patent is extended or adjusted under 35 U.S.C. 154(b) by 1023 days.

(21) Appl. No.: 11/898,081

(22) Filed: Sep. 10, 2007

(65) Prior Publication Data

US 2009/0067982 A1 Mar. 12, 2009

(51) Int. Cl.
*F04D 5/00* (2006.01)
*F04D 29/66* (2006.01)

(52) U.S. Cl. ..... 415/53.1; 415/119; 416/244 R

(58) Field of Classification Search ..... 415/53.1; 416/500, 204 R
See application file for complete search history.

(56) References Cited

U.S. PATENT DOCUMENTS 5,052,888 A * 10/1991 Bolton et al. ..... 415/182.1

FOREIGN PATENT DOCUMENTS

JP 01147194 A * 6/1989

* cited by examiner

*Primary Examiner* — Richard Edgar
(74) *Attorney, Agent, or Firm* — Rosenberg, Klein & Lee

(57) ABSTRACT

An improved cross flow fan assembly applicable but not limited to a panel meter of fitness equipments includes: a housing and a cross flow fan made of plastic; a fan body, having symmetric circular flanges integrally formed on both lateral ends by plastic injection molding; two side covers, embedded into two circular flanges; and a shock absorption positioning member, installed at an external side of the right panel, and including: an axle center with a front section embedded into a bushing of the right cover and a rear section sheathed into a bearing, and a rubber pad, embedded into a circular hole of the right panel by its circular groove at the periphery for wrapping the bearing, so as to constitute a plastic cross flow fan module, and achieving a fast and convenient assembling and a vibration resisting effect, and the fan comes with a smooth operation to reduce noises.

4 Claims, 9 Drawing Sheets

CROSS FLOW FAN

BACKGROUND OF THE INVENTION

1. Field of the Invention

The present invention relates to a cross flow fan, and more particularly to a cross flow fan applicable but not limited to a panel meter of a fitness equipment, and the cross flow fan and its housing are made of a plastic material.

2. Description of the Related Art

As exercisers often sweat a lot when working on fitness equipments, it is delightful to have steady cool air blowing directly at the exercisers while they are doing exercises. Referring to FIG. 1 for a conventional treadmill machine M, the treadmill machine M includes an axial flow fan installed separately on both sides of a panel meter, and the airflow direction of this type of fan is parallel to the axle. In other words, air is flowing upward instead of blowing directly at an exerciser on the treadmill machine, and such arrangement obviously requires improvements.

Referring to FIGS. 2 and 3 for schematic views of a conventional cross flow fan assembly, the assembly comprises a housing 11, a motor 12 and a cross flow fan 13. The inventor of the present invention attempts to install a conventional cross flow fan 10 in a panel meter of a treadmill machine to replace the traditional axial flow fan F, but the following drawbacks are still found in its testing procedure:

1. The housing 11 and the cross flow fan 13 of the structure of a conventional cross flow fan 10 are made of metal plates, and the housing 11 is manufactured by stamping, riveting and coupling at least four metal plates. With the weight limitation, the metal plates cannot be too thick, and thus the structural strength of the assembled housing 11 is poor.

2. More importantly, the cross flow fan 13 is made by riveting and coupling metal plates and metal pillars. Over ten metal vanes 131 are embedded into the metal panels 132, 133 having grooves disposed on left and right sides, and then the middle of the left metal panel 132 is riveted with a bushing 133 connected to an axle 121 of the motor 12, and the middle of the right metal panel 134 is riveted with a center shaft 135. After a center shaft 135 is sheathed into a sleeve 14, the center shaft 135 is installed to the housing 11 by an axial positioning base 15. However, most of these cross flow fans 10 are made of metals, and most of the connections are achieved by stamping, riveting and welding, and thus the manufacture is more complicated, and the required streamline design cannot be achieved easily. If the cross flow fan 13 is driven by the motor 12 to rotate transversally in the x-x direction, and the length L of the cross flow fan 11 is slender, the circularity of the riveted metal vanes 131 will be affected, and the operation of the fan will become unsmooth, and thus such fan is not suitable to be installed in the panel meter of the fitness equipment. Although the problems created by the metal material and its rivet connection do not affect the usage of industrial products, yet the prior art is not suitable to be used in a panel meter installed with precision electronic components.

In view of the shortcomings of the prior art, the inventor of the present invention based on years of experience in the related industry to conduct extensive researches and experiments, and finally developed a stable cross flow fan for a fitness equipment to overcome the aforementioned shortcomings.

SUMMARY OF THE INVENTION

It is a primary object of the invention to provide an improved cross flow fan assembly, wherein its housing and cross flow fan are made of a plastic material and skillfully assembled into a plastic cross flow fan module. The invention not only provides a quick and convenient assembling, but also enhances the overall strength and the operation of the fan.

Another objective of the present invention is to provide an improved cross flow fan assembly, and the cross flow fan comes with a vibration resisting design for preventing vibrations and reducing noises, and thus the cross flow fan is applicable for fitness equipments.

In order to achieve the above-mentioned objects, an improved cross flow fan assembly includes:

a) a housing having left and right side panels and an L-shape baffle fixed between the left and right side panels;

b) a cross flow fan installed between the left and right side panels; and c) a motor, installed at an external side of the left panel, and having an axle extended into an internal side of the left panel for driving the cross flow fan, wherein the housing and the cross flow fan are made of a plastic material, and comprise:

i) a fan body integrally formed by a plastic injection molding, and being a cylindrical fan body having a plurality of transversal long vanes arranged in a circular shape, and symmetrical circular flanges formed on both lateral ends of the fan body;

ii) left and right covers made of plastic, and being a body embedded and fixed into the two circular flanges on both lateral sides, and having a sleeve formed at the center of the left cover for passing and coupling an axle of the motor, and a sleeve hole disposed at the center of the right cover for embedding into a bushing; and iii) a shock absorption positioning member, installed on an external side of the right panel, and including an axle center with a front section embedded into the bushing of the right cover and a rear section sheathed into a bearing, and a rubber pad, with a circular groove at its periphery embedded into a circular hole of the right panel, and wrapping the bearing, so as to constitute a plastic cross flow fan module.

DETAILED DESCRIPTION OF THE PREFERRED EMBODIMENT

Figure 1:
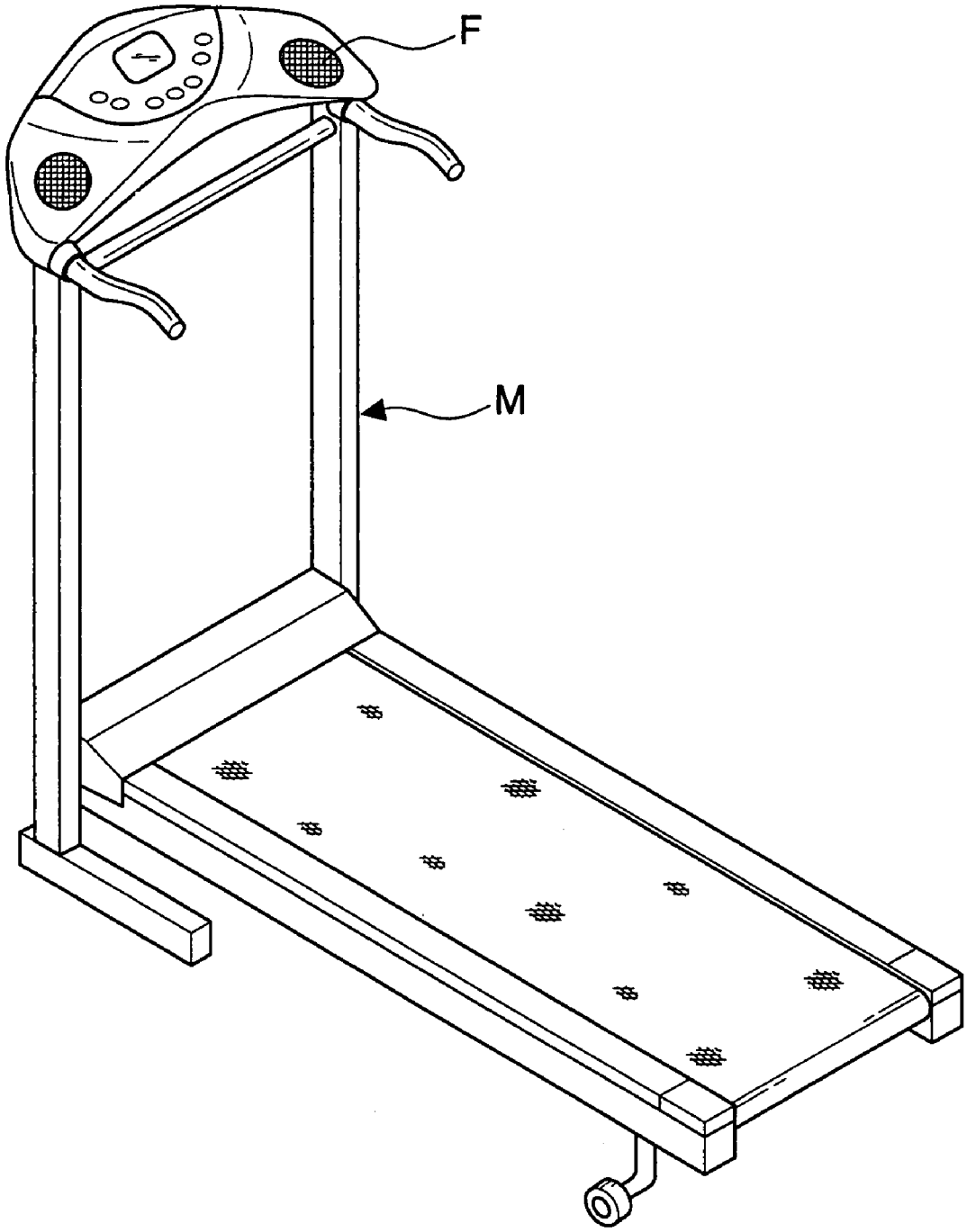
FIG.1 PRIOR ART
FIG. 1 is a schematic view of a conventional treadmill machine installed with an axial fan.
Figure 2:
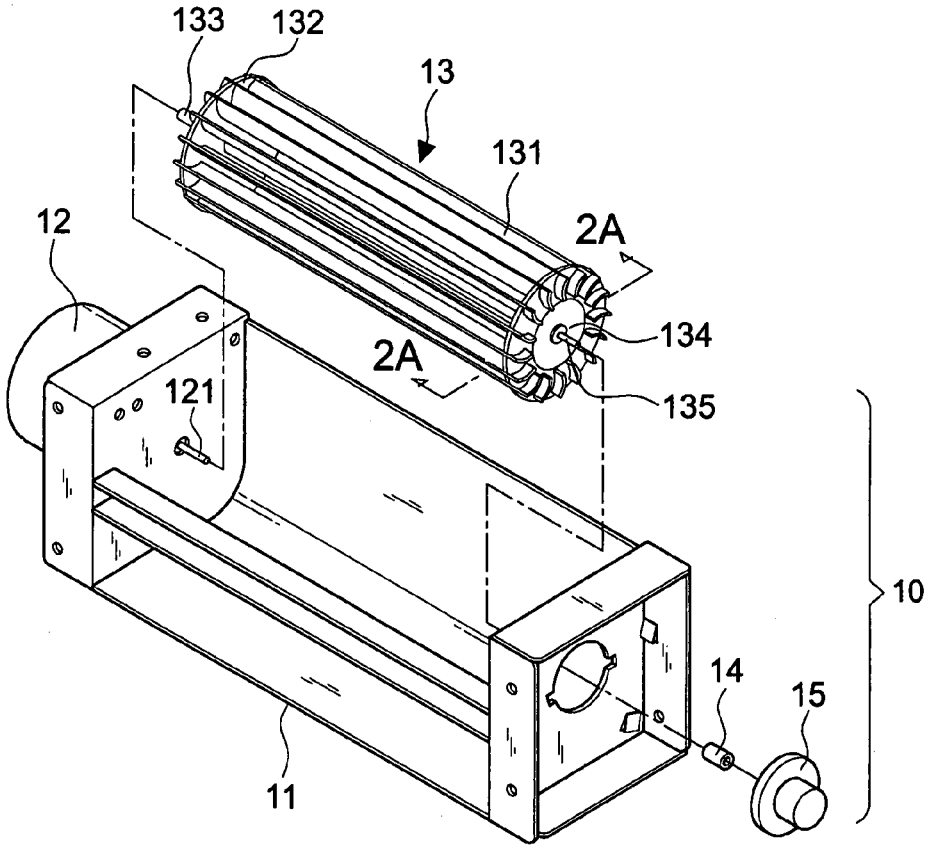
FIG.2 PRIOR ART
FIG. 2 is an exploded view of a conventional cross flow fan.
Figure 2A:
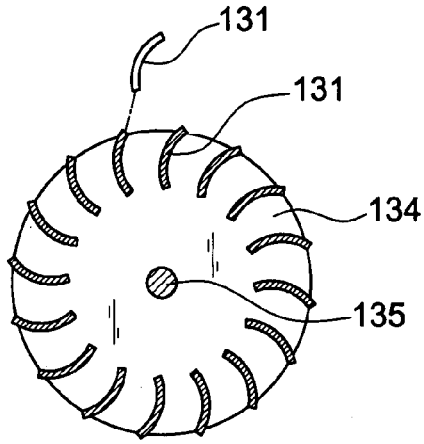
FIG.2(A) PRIOR ART
FIG. 2A is a cross-sectional view of Section 2A-2A as depicted in FIG. 2.
Figure 3:
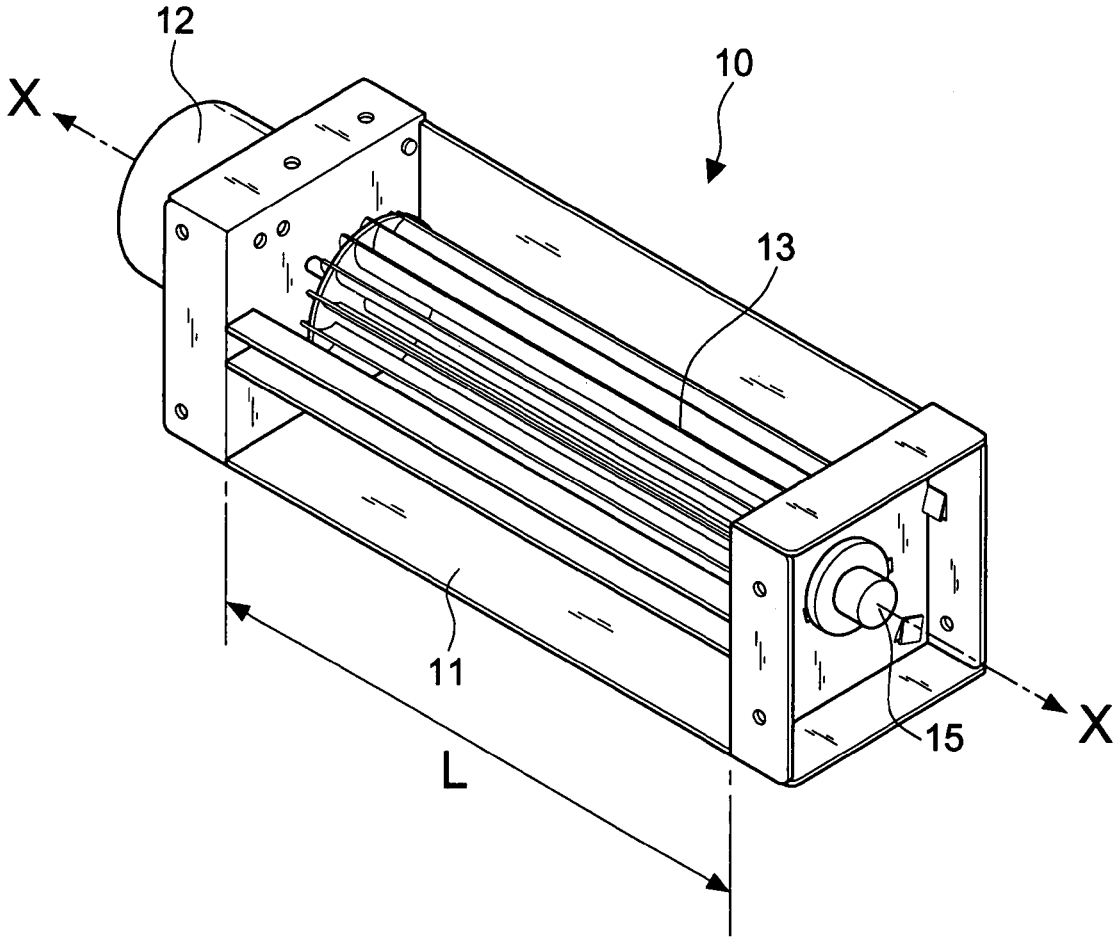
FIG.3 PRIOR ART
FIG. 3 is a perspective of a conventional cross flow fan assembly.

Referring to FIGS. 4 to 7, a preferred embodiment of the present invention comprises: a housing 50, made of a plastic material, and having a left panel 20, a right panel 30, and an L-shape baffle 40; a cross flow fan 60, also made of a plastic material, and installed between the left and right panels 20, 30; and a motor 80, installed on an external side of the left panel 20, and its axle 81 is extended into an internal side for driving the cross flow fan 60.

Figure 5:
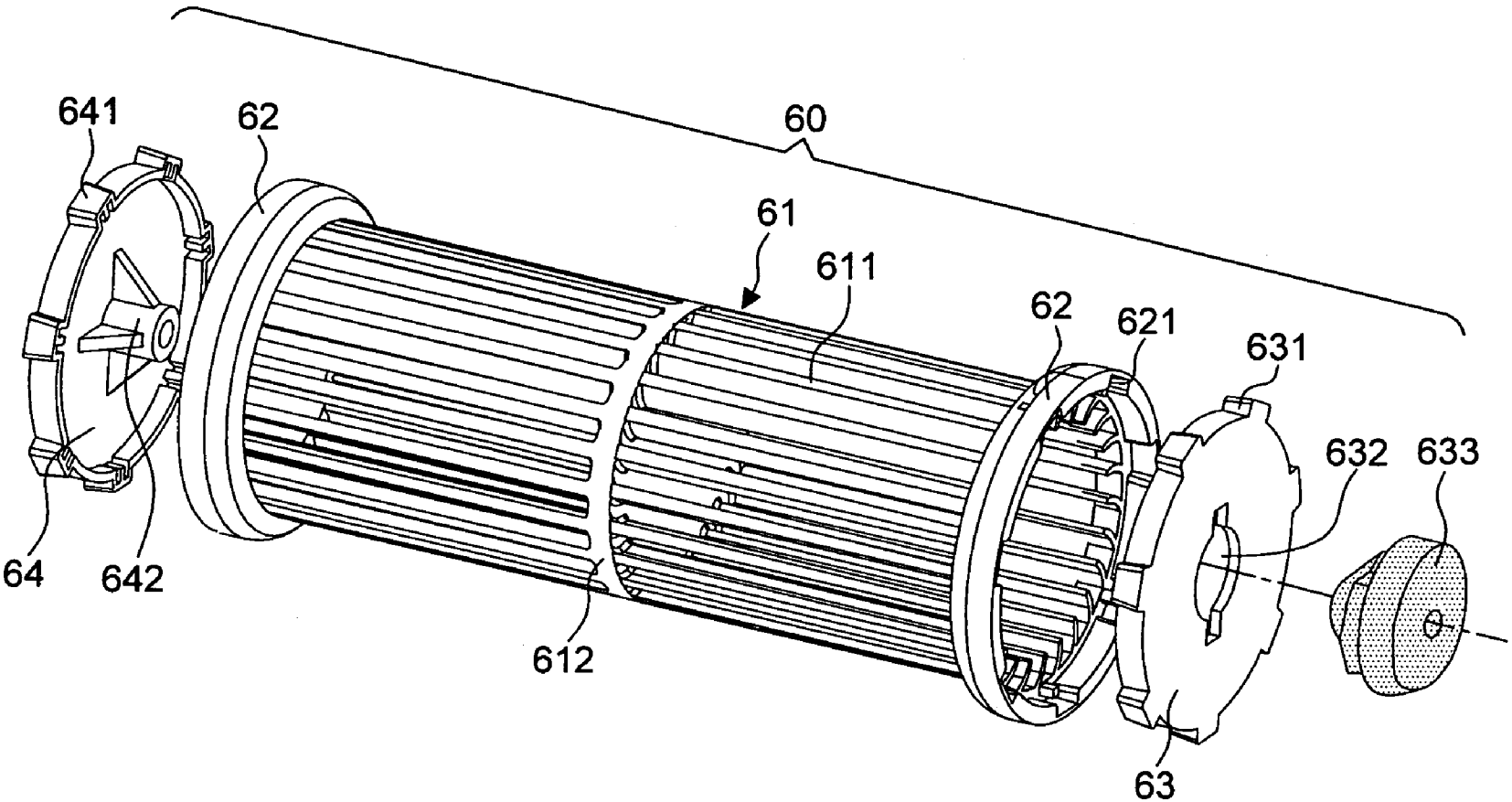
FIG. 5 is an exploded view of a cross flow fan of the present invention.

The assembly of the housing 50 and the cross flow fan 60 in accordance with the present invention further comprises a fan body 61, as shown in FIG. 5, being integrally formed by plastic injection molding into a cylindrical body that includes a plurality of long vanes 611 disposed transversally along the x-x direction and arranged in a circular shape, and symmetrical circular flanges 62 are formed on both lateral sides of the fan body 61. Since the entire fan body 61 is integrally formed by plastic injection molding, therefore its circularity is good. A reinforced circular rib 612 can be built at the middle section of the fan body 61, so that the long vanes 611 will not be deformed easily. Further, the flanges 62 on both sides of the fan body 61 can be designed with a streamlined shape, such that the overall structure of the fan body 61 is secured and stable, and the long vanes 611 will not be deformed easily even in high-speed operations.

The left and right covers 64, 63 are made of a plastic material, and in the form of a body embedded and fixed in the circular flanges 62 on both sides, and a sleeve 642 is integrally formed at the middle of the left cover 64 for passing and coupling an axle 81 of the motor 80, and a sleeve hole 632 is disposed at the center of the right cover 63 and embedded into a bushing 633. In addition, the external periphery of the left and right covers 64, 63 further comprises a plurality of protruding teeth 641, 631 to be embedded into a plurality of slots 621 at the positions corresponding to the internal periphery of the circular flange 62 for latching with each other. Of course, a high frequency welding or gluing process can be performed to prevent the protruding teeth 641, 631 from falling out from the slots 621 easily. These arrangements are prior arts, and thus will not be described here.

Figure 4:
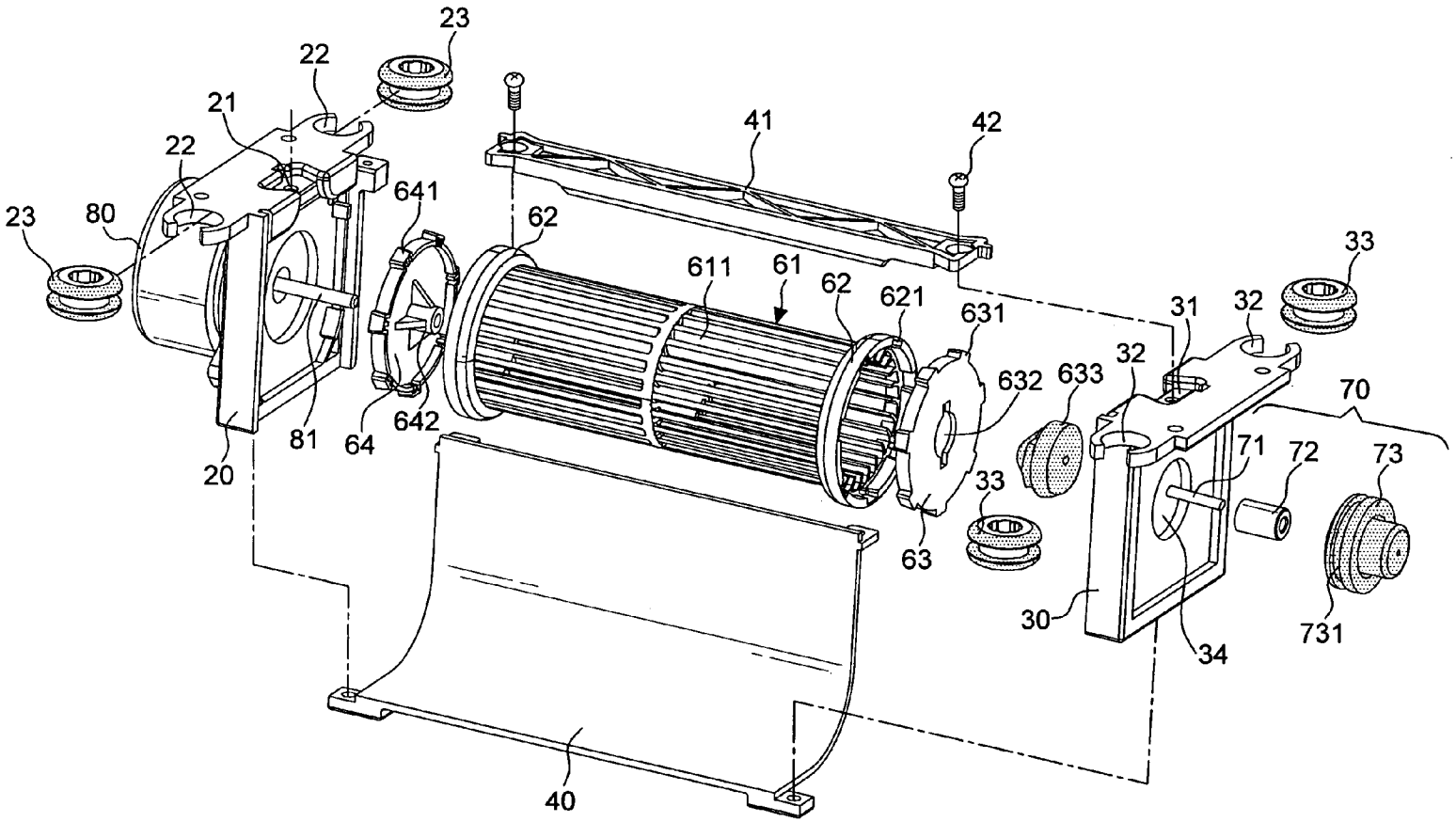
FIG. 4 is an exploded view of the present invention.
Figure 6:
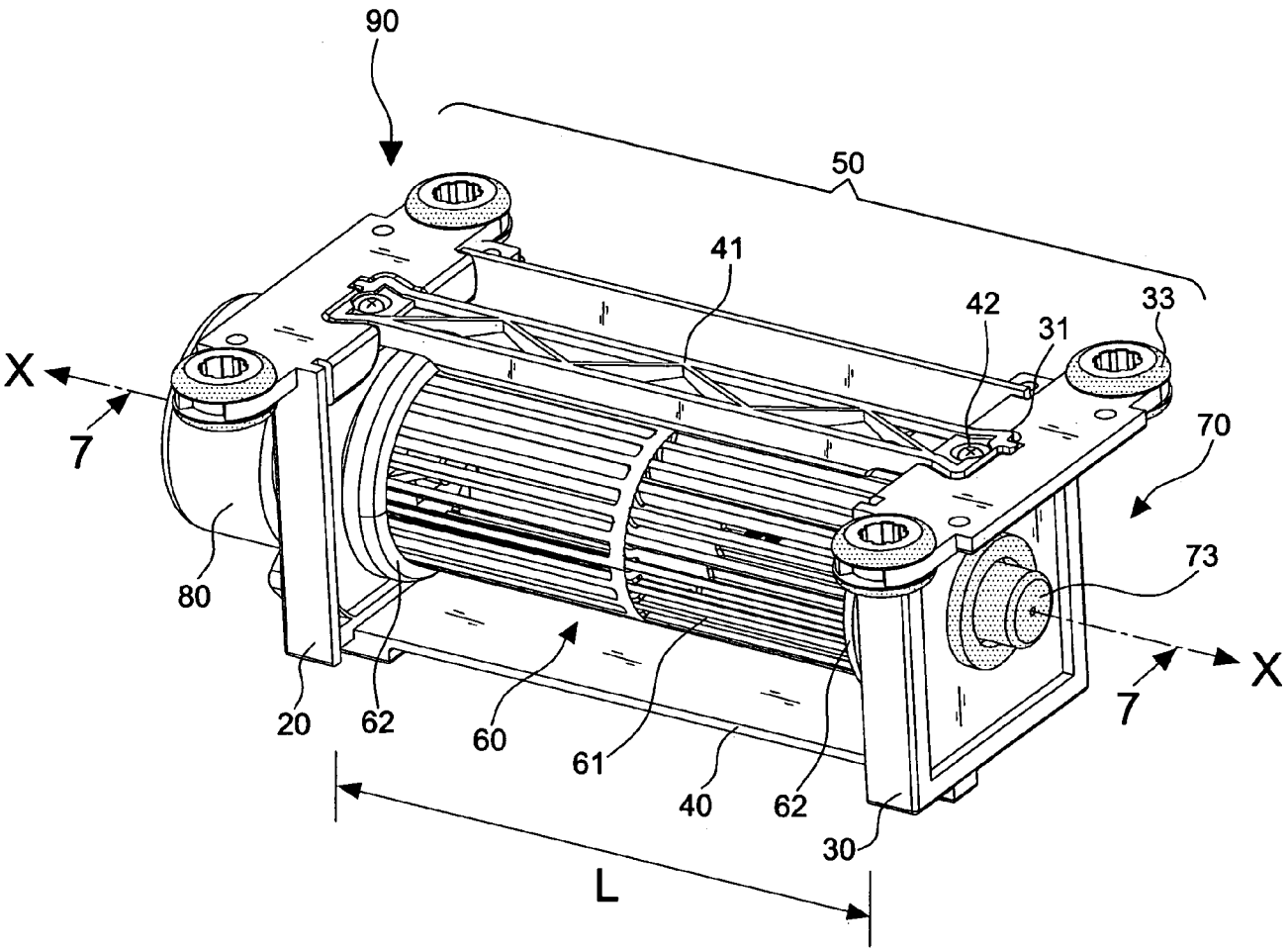
FIG. 6 is a perspective view of an assembly of the present invention.
Figure 7:
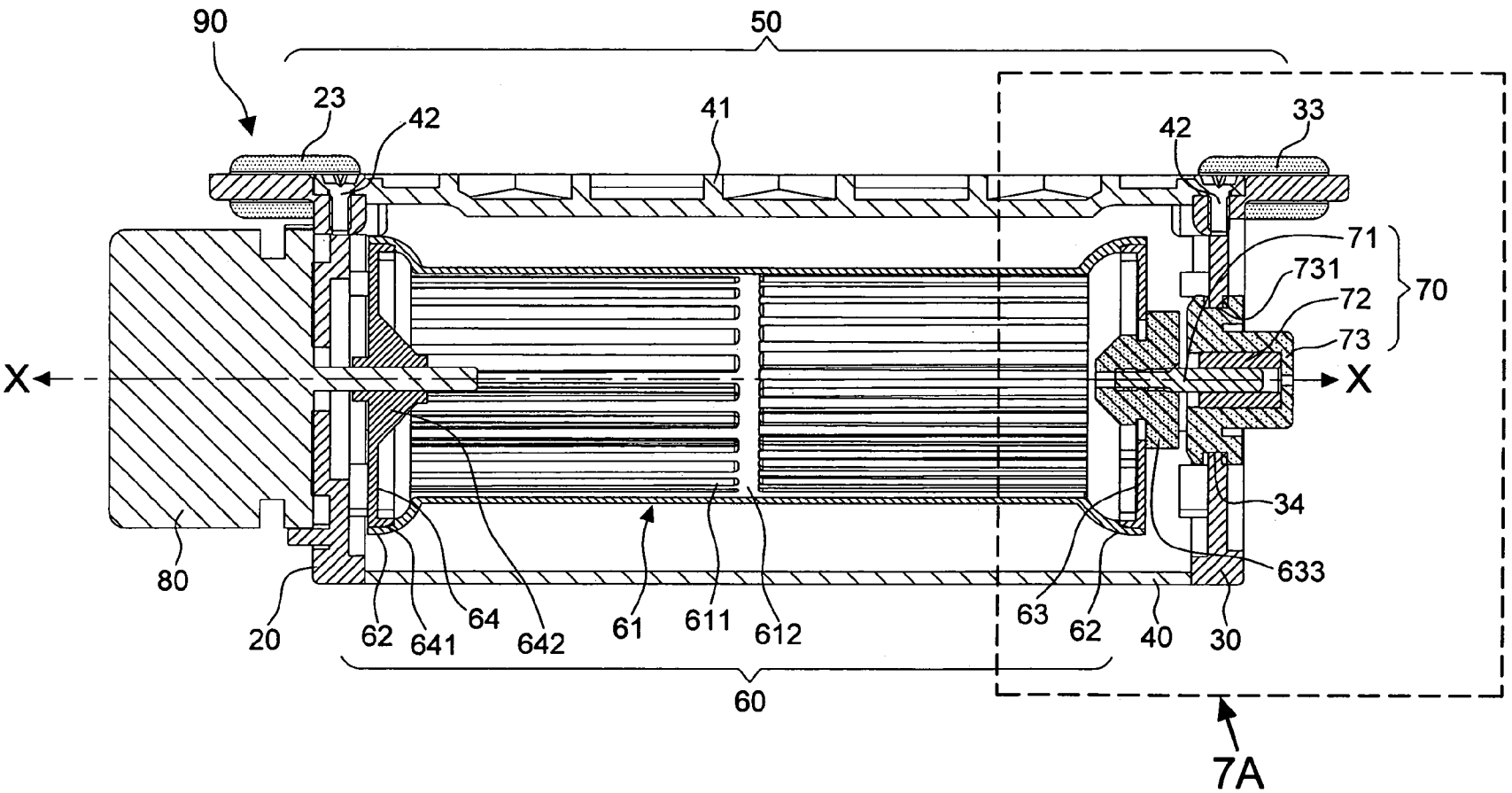
FIG. 7 is a section view of the present invention.

Further, a shock absorption positioning member 70 as shown in FIGS. 4, 6 and 7 is installed at an external side of the right panel 30, and the shock absorption positioning member 70 comprises: an axle center 71 with its front section embedded into the bushing 633 of the right cover 63 and its rear section embedded into a bearing 72; and a rubber pad 73, having its circular groove 731 embedded into the circular hole 34 of the right panel 30 by the periphery of the rubber pad 73 and covering the bearing 71, so as to constitute a plastic cross flow fan module 90.

Further, a C-shape slot 22, 32 is disposed separately at front and rear ends of the top of the left and right side panels 20, 30 for embedding a rubber bushing 23, 33 to provide a buffering function. Therefore, the housing 50 includes four rubber bushings 23, 33 at four distal portions of the housing 50 that can provide better buffering and shock absorption effects when the cross flow fan is installed to the fitness equipment.

The left and right side panels 20, 30 further include a transversal fixed board 41, with both distal portions embedded into a concave surface 31 at the top of the left and right side panels 20, 30, and fixed by a screw 42 for fixing the entire housing 50 more securely.

Figure 7A:
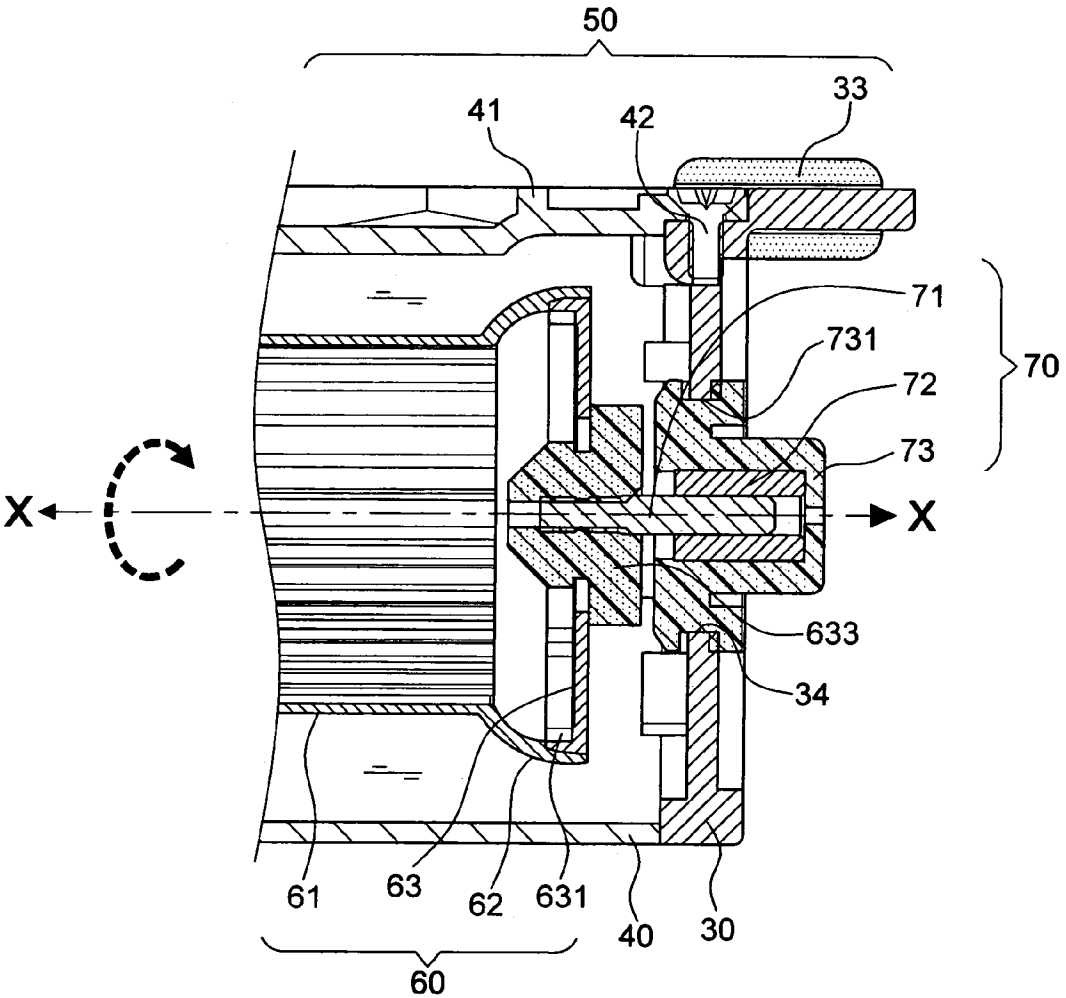
FIG. 7A is an enlarged view of FIG. 7.
Figure 8:
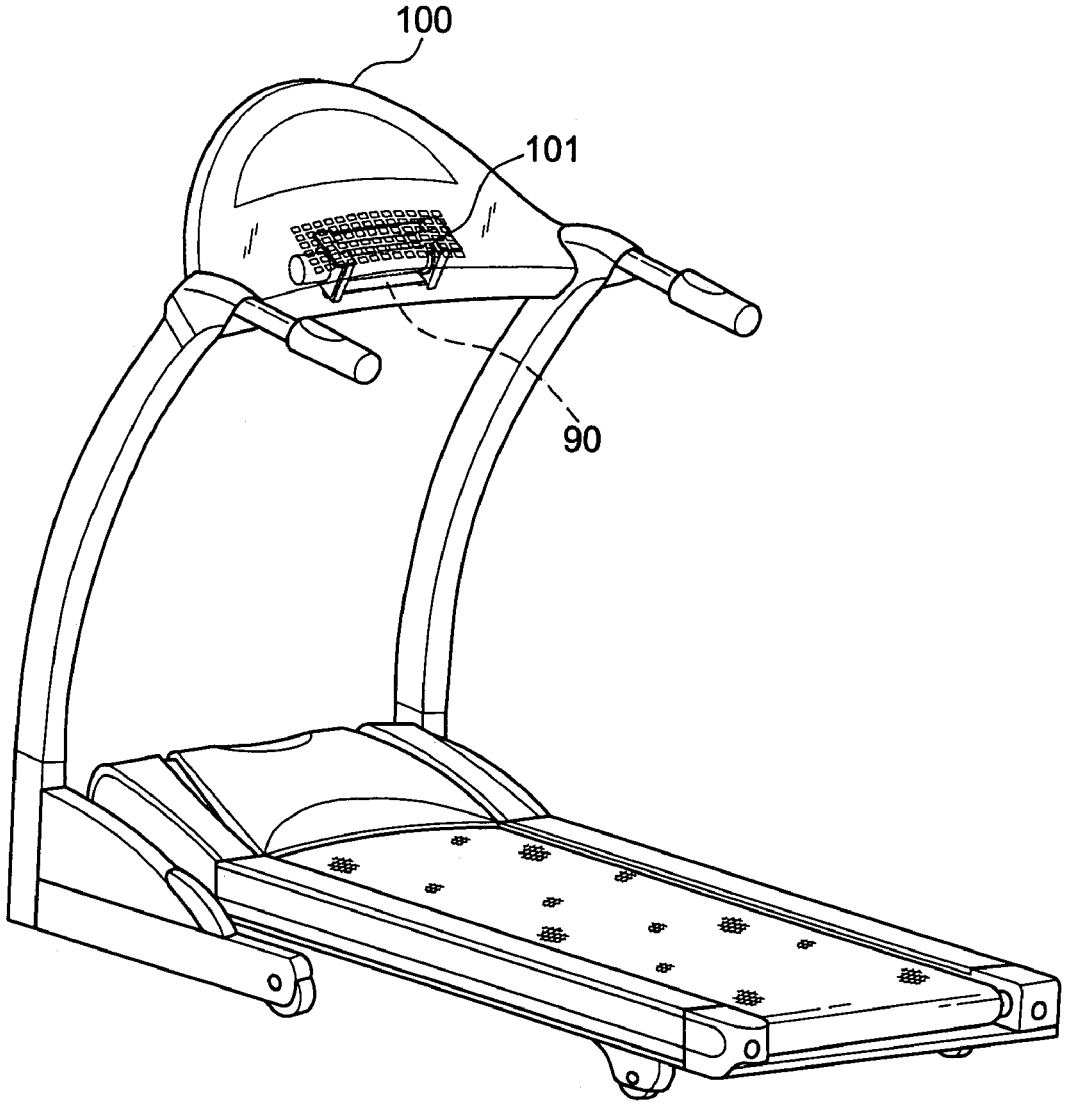
FIG. 8 shows an application of the present invention.

With the foregoing technical measures, the assembly of the present invention as shown in FIG. 6 has a total weight less than the conventional metal fan, but its structure is stronger and the metal plates can be riveted and connected faster and more convenient. When the cross flow fan 60 is rotated transversally in the X-X direction, the fan will not be deformed easily even the length L is relatively large. In FIGS. 7 and 7A, when the cross flow fan 60 is rotated with respect to the X-X axis, an axle center 71 is supported by the bearing 72, and the rotating force received by the bearing 72 is absorbed and eliminated by the rubber pad 73 wrapped around the external periphery of the bearing 72, so as to achieve the vibration resisting effect. Since the cross flow fan 60 will not be deformed easily and its operation is smooth, therefore the wind resistance can be lowered and the wind shear and jitter noise can be reduced. Therefore, the cross flow fan of the invention can be installed in the panel meter 100 of the fitness equipment as shown in FIG. 8, and its air flow blows at the exerciser from the air outlet 101, so that the exerciser can enjoy the cool wind while doing exercises.

Many changes and modifications in the above-described embodiment of the invention can, of course, be carried out without departing from the scope thereof. Accordingly, to promote the progress in science and the useful arts, the invention is disclosed and is intended to be limited only by the scope of the appended claims.

What is claimed is:

1. An improved cross flow fan assembly, comprising:

a) a housing having left and right side panels and an L-shape baffle fixed between the left and right side panels;

b) a cross flow fan installed between the left and right side panels; and c) a motor, installed at an external side of the left panel, and having an axle extended into an internal side of the left panel for driving the cross flow fan, wherein the housing and the cross flow fan are made of a plastic material, and comprise:

i) a fan body integrally formed by a plastic injection molding, and being a cylindrical fan body having a plurality of transversal long vanes arranged in a circular shape, and symmetrical circular flanges formed on both lateral ends of the fan body;

ii) left and right covers made of plastic, and being a body embedded and fixed into the two circular flanges on both lateral sides, and having a sleeve formed at the center of the left cover for passing and coupling an axle of the motor, and a sleeve hole disposed at the center of the right cover for embedding into a bushing;

iii) a shock absorption positioning member, installed on an external side of the right panel, and including an axle center with a front section embedded into the bushing of the right cover and a rear section sheathed into a bearing, and a rubber pad, with a circular groove at its periphery embedded into a circular hole of the right panel, and wrapping the bearing, so as to constitute a plastic cross flow fan module; and iv) a C-shape slot formed separately at front and rear ends of the top of the left and right side panels and embedded into a buffering rubber bearing.

2. The improved cross flow fan assembly as recited in claim 1, wherein the left and right side panels further comprise a transversal fixed board with both ends embedded separately into a concave surface disposed on the left and right side panels and secured by a screw.

3. The improved cross flow fan assembly as recited in claim 1, wherein the cross flow fan further includes a plurality of protruding teeth disposed at the external periphery of the left and right covers and embedded into corresponding slots at the internal periphery of the circular flanges for latching with each other.

4. The improved cross flow fan assembly as recited in claim 1, wherein the plastic cross flow fan module is installed in a panel meter of a fitness equipment.

* * * * *